US006871663B2

(12) United States Patent
Groeneveld

(10) Patent No.: US 6,871,663 B2
(45) Date of Patent: Mar. 29, 2005

(54) DRIVING MECHANISM, FUNCTION PART AND SHUT-OFF VALVE

(75) Inventor: Floris Johannes Groeneveld, Hengelo (NL)

(73) Assignee: EL-O-Matic B.V., Hengelo (NL)

( * ) Notice: Subject to any disclaimer, the term of this patent is extended or adjusted under 35 U.S.C. 154(b) by 146 days.

(21) Appl. No.: 10/398,976

(22) PCT Filed: Oct. 11, 2001

(86) PCT No.: PCT/NL01/00750

§ 371 (c)(1),
(2), (4) Date: Apr. 10, 2003

(87) PCT Pub. No.: WO02/31363

PCT Pub. Date: Apr. 18, 2002

(65) Prior Publication Data

US 2004/0089341 A1 May 13, 2004

(30) Foreign Application Priority Data

Oct. 11, 2000 (NL) ..... 1016385

(51) Int. Cl.[7] ..... F15B 15/20; F15B 15/08; F15B 13/00

(52) U.S. Cl. ..... 137/271; 251/129.04

(58) Field of Search ..... 137/271, 269; 251/129.04

(56) References Cited

U.S. PATENT DOCUMENTS

| | | | | |
|---|---|---|---|---|
| 3,189,700 A | | 6/1965 | Eidson | 200/61.86 |
| 3,589,387 A | * | 6/1971 | Raymond | 137/271 |
| 3,976,098 A | * | 8/1976 | Raymond | 137/271 |
| 4,150,686 A | | 4/1979 | El Sherif et al. | 137/377 |
| 4,964,273 A | | 10/1990 | Nash | 60/325 |
| 6,422,532 B1 | * | 7/2002 | Garner | 251/129.04 |
| 6,715,400 B2 | * | 4/2004 | Muth et al. | 137/269 |

FOREIGN PATENT DOCUMENTS

| | | |
|---|---|---|
| DE | 298 18 075 U1 | 2/1999 |
| DE | 299 04 234 U1 | 8/1999 |
| EP | 0 824 196 A1 | 2/1998 |
| FR | 2 738 789 A | 3/1997 |
| NL | 7 512 312 A | 4/1977 |
| WO | WO 96 31704 A | 10/1996 |

OTHER PUBLICATIONS

International Search Report for PCT/NL01/00750, issued Feb. 11, 2002.

* cited by examiner

*Primary Examiner*—Kevin Lee
(74) *Attorney, Agent, or Firm*—Marshall, Gerstein & Borun LLP

(57) ABSTRACT

The invention relates to a pneumatic, reciprocating rotary driving mechanism unit for operating a shut-off member in a shut-off valve, comprising a substantially closed housing, in which a drive shaft (30) is journalled, a pneumatic control valve (39–42) for controlling said drive shaft and first signal transmitting means (54, 55) for delivering control signals to said pneumatic control valve, wherein the housing consists of a base part (48), in which the drive shaft and the pneumatic control valve are present, and a first function part (53), in which the first signal transmitting means are present, which first function part is detachably and exchangeably connected to said base part so as to make it possible to exchange said first function part for a second function part containing second signal transmitting means of a type for the purpose of changing the manner in which the drive shaft can be controlled.

18 Claims, 11 Drawing Sheets

DRIVING MECHANISM, FUNCTION PART AND SHUT-OFF VALVE

BACKGROUND OF THE INVENTION

The invention relates to a pneumatic, reciprocating rotary driving mechanism unit for operating a shut-off member in a shut-off valve, comprising a substantially closed housing, in which a drive shaft is journalled which can be connected to said shut-off member, a pneumatic control valve for controlling said drive shaft and first signal transmitting means for delivering control signals to said pneumatic control valve. The driving mechanism as disclosed in Dutch laid-open publication no. 7512312, which is used with peripheral equipment in practice, fits the above description. Such driving mechanisms are generally used for operating butterfly valves, plug valves and ball valves as well as also lamellas in dampers, wherein the angle of rotation of the drive shaft is limited to maximally 180° and usually to 90°. To this end, all kinds of pneumatic components and control equipment are mounted on the outside of the housing, such as the control valve and a signal transmitter.

In a functional situation wherein the drive shaft only needs to be capable of taking up two positions corresponding with an open position and a closed position of the shut-off valve, such peripherals generally comprise a so-called solenoid which is mounted on the outside of the housing, which solenoid converts the electrical control signals from a central electronic control system into pneumatic control signals for operating a pneumatic control valve, which also forms part of the solenoid. A switch box is mounted on to the housing via a bridge, in line with the free end of the drive shaft, which switchbox transmits information about, amongst other things, the actual rotational position of the drive shaft to the central control system, such as a PLC unit. The switch box and the solenoid are interconnected by means of a line outside of the housing for the purpose of exchanging information.

In the functional situation wherein the drive shaft is to be driven in a modulating manner, that is, enabling continuously variable adjustment of the valve between an open position and a closed position, a so-called positioner is mounted on the outside of the housing instead of said solenoid and said switch box, which positioner is capable of continuously variable adjustment of the shut-off member of the shut-off valve between 0–100%, for example by means of a control current of 4–20 mA. Lines are provided outside of the housing for operating the shut-off member.

Units such as a solenoid, a switch box or a positioner must be capable of communication with all kinds of control equipment. This implies that a great many variants of each of the aforesaid components are required. As a result of this it has appeared to be very difficult, costly and time-consuming in practice to change the functionality of a pneumatic driving mechanism. In addition, the driving mechanisms according to the prior art are quite vulnerable, due to the way in which the peripherals are connected to the housing and to each other.

The object of the invention is to provide a solution for the above drawbacks and to meet the aforesaid need. In order to accomplish that objective, the driving mechanism according to the invention is characterized in that the housing consists of a base part, in which the drive shaft and the pneumatic control valve are present, and a first function part, in which the first signal transmitting means are present, which first function part is detachably and exchangeably connected to said base part so as to make it possible to exchange said first function part for a second function part containing second signal transmitting means of a type different from the first signal transmitting means, which first function part is exchanged for the second function part for the purpose of changing the manner in which the drive shaft can be controlled. The invention is based on the insight that some of the components of which the driving mechanism is built up are required for every function that is desired, whilst other components are only required for specific functions. According to the invention, the former components are housed in the base part. By housing the latter components in a specific function part, which is detachably connected to the base part, a simple exchangeability of the function part and thus of the functionality of the pneumatic driving mechanism is effected without any adaptations or the exchange of the base part being required. It is not so much the pneumatic components that make up the difference between the function parts mutually, but rather the electronic components that are present therein, since it is the latter that determine the functionality in question and that can be considered as signal transmitting means. The function part can on the one hand be designed as a black box without control buttons or information panels, but on the other hand it may be designed to comprise sensors, switches, various electrical terminals, manual operation provisions, for example for emergency operation, LED's, LCD's, etc. The integration thereof in the function part obviates the need for additional electrical wiring and/or pneumatic connections.

As an aside it is noted that German utility model DE 298 18075 U1 discloses a fluidic linear actuator comprising a housing in which a piston whose piston rod extends outside the housing is present. Present on the housing is a two-part control housing. A fluidic feed connection is formed in the first part, whilst an electronic control unit is present in the second part, whereby there is an electrical connection between the first part and the second part so as to enable electronic data transfer between the first part and the second part. Present in the first part is a signal transmitting valve, which delivers pneumatic control signals to a pneumatic control valve which is also present in the first part. The actuator disclosed in said publication is only suitable for actuating the piston in one and the same manner, whereby the second part, on the other hand, can be adapted to enable communication with various types of artificial intelligence remote from the actuator.

Advantageously, at least one mechanical portion of a position indicator, which is movable in dependence on the rotation of the drive shaft, is housed in the base part for the purpose of showing and/or transmitting information about the rotational position of the drive shaft. Integration of the position indicator in the base part on the one hand makes it possible to realise a compact and robust construction, whilst on the other hand no vulnerable external lines for the control system are required. By housing the mechanical components of the position indicator at least in part in the base part and housing the electronics in the function part it becomes possible to prevent a situation wherein mechanisms operate between the base part and the function part in a vulnerable manner. In addition, no mechanical adjustment of the position indicator is required when a function part is being connected to a base part. The function part converts the movement or the position of the mechanical part of the position indicator into electronic information for feedback to a control system.

SUMMARY OF THE INVENTION

According to one preferred embodiment, the base part comprises two interconnected housing parts, wherein the drive shaft is present in the first housing part and the second housing part accommodates the control valve. This is advantageous, both as regards the production and as regards the maintenance of the driving mechanism, since the two housing parts are accessible independently of each other in disconnected condition.

According to one preferred embodiment, the mechanical portion of the position indicator is at least partially housed within the second housing part. This makes for a compact construction.

Furthermore it is very advantageous if the first function part is detachably connected to the second housing part, since this makes it possible to use short communication lines between the pneumatic control valve and the signal transmitting means in question, which reduces the vulnerability thereof, whilst furthermore the distance between a mechanical portion of a position indicator in the second housing part and the electronics in the function part that processes information on the position of the position indicator can be small.

The second housing part is preferably disposed outside the central axis of the drive shaft, so that both ends of the drive shaft will be available, for example for the rotary drive of external means or for a visual position indicator.

According to a very advantageous embodiment, the shapes of the base part and the function part are complementary to each other. The absence of connecting pieces, such as bridges, obviates the need to use vulnerable lines via or along such a connecting piece between the base part and the function part. In addition, the driving mechanism, including the base part and the function part, will look as one unit.

If, in accordance with one preferred embodiment of the invention, each function part comprises all function-specific electronics associated with the function of the function part in question, a maximum degree of flexibility is obtained for changing the function of the driving mechanism, if desired. In addition, this obviates the need for electronic signal transmission between the base part and the function part. Such electronic signal transmission is vulnerable and for that reason not sufficiently reliable for certain applications, for example owing to corrosion of the contact points of plugs. In addition to that, only the function part needs to be subjected to a test in the case of safety inspections carried out in connection with the risk of explosion.

In order to enhance safety when using a driving mechanism according to the invention, the electronics are preferably embedded in order to reduce the risk of fire or explosion, because the risk of arcing is eliminated.

A very useful embodiment of a driving mechanism according to the invention is obtained if one of said first function part and said second function part is suitable for positioning the drive shaft in two positions only and the other one of said first function part and said second function part is suitable for positioning the drive shaft in an intermediate position between said two positions as well. Thus it is possible without adapting or exchanging the base part, but only by exchanging the function part, to convert the driving mechanism from a situation wherein the drive shaft can only be placed in two positions corresponding with an open position and a closed position of the shut-off member of a shut-off valve, to a situation wherein the driving mechanism is also suitable for placing the shut-off member in a position between an open position and a closed position, for example in a half-open position. This may be useful, for example, when testing shut-off members in connection with emergency situations. Such shut-off members are sometimes referred to as Emergency Shutdown Valves, whereby it is ascertained annually whether a shut-off member can be opened 10%, which is a clear indication that the valve is satisfactory. Another possible use of the driving mechanism is in the filling of bags with powdery material, wherein a distinction is made between coarse metering and fine metering.

In such a situation it may be very advantageous if the position between an open position and a closed position can be selected at random, thereby creating a modulating situation, to which end the driving mechanism is advantageously characterized in that the other one of the first function part and the second function part is suitable for placing the drive shaft in any desired position between the aforesaid two positions.

Preferably, the control signals from the first signal transmitting means and from the second signal transmitting means are pneumatic signals, which leads to a reduced cost price on the one hand and to greater reliability on the other hand.

Preferably, one of the facing sides of said function part and said base part, or both, is (are) provided with a pattern, as a result of which at least part of the pneumatic circuit for the pneumatic control signals is formed between the function part and the base part in the situation wherein the function part is connected to the base part, all this for the purpose of transmitting pneumatic signals from the signal transmitting means to the pneumatic control valve. Such a configuration is advantageous with regard to obtaining a compact assembly of base part and function part.

In particular in the case of such pneumatic control signals it is advantageous if the first signal transmitting means and the second signal transmitting means each comprise a pneumatic valve for delivering pneumatic control signals to the pneumatic control valve.

In order to obtain an even more compact construction, the function part comprises a mechanical portion of the position indicator, just like the base part, which mechanical portion can be connected to the mechanical part of the position indicator that is housed in the base part.

To this end, the base part is preferably provided with a recess for accommodating the mechanical portion of the position indicator that is present in the function part, as a result of which an optimal screening of the mechanical parts of the position indicator is achieved. Reading of the position indicator is possible, for example, because the mechanical portion of the position indicator that is present in the function part is fitted with a magnet, whose position can be determined by means of a magneto-resistive sensor which is likewise present in the function part.

In view of the inherent exchangeability of the function part, it is of major importance to state that the invention also relates to a function part for use with a driving mechanism according to the above-described invention. Such a function part includes signal transmitting means for converting an electrical control signal into a pneumatic control signal for a pneumatic control valve which is present in a base part of the driving mechanism.

The invention furthermore relates to a shut-off valve comprising a shut-off member, which is provided with a driving mechanism according to the above-described invention.

BRIEF DESCRIPTION OF THE DRAWINGS

The invention will now be explained in more detail with reference to the following figures.

DESCRIPTION OF THE PREFERRED EMBODIMENT

Figure 1:
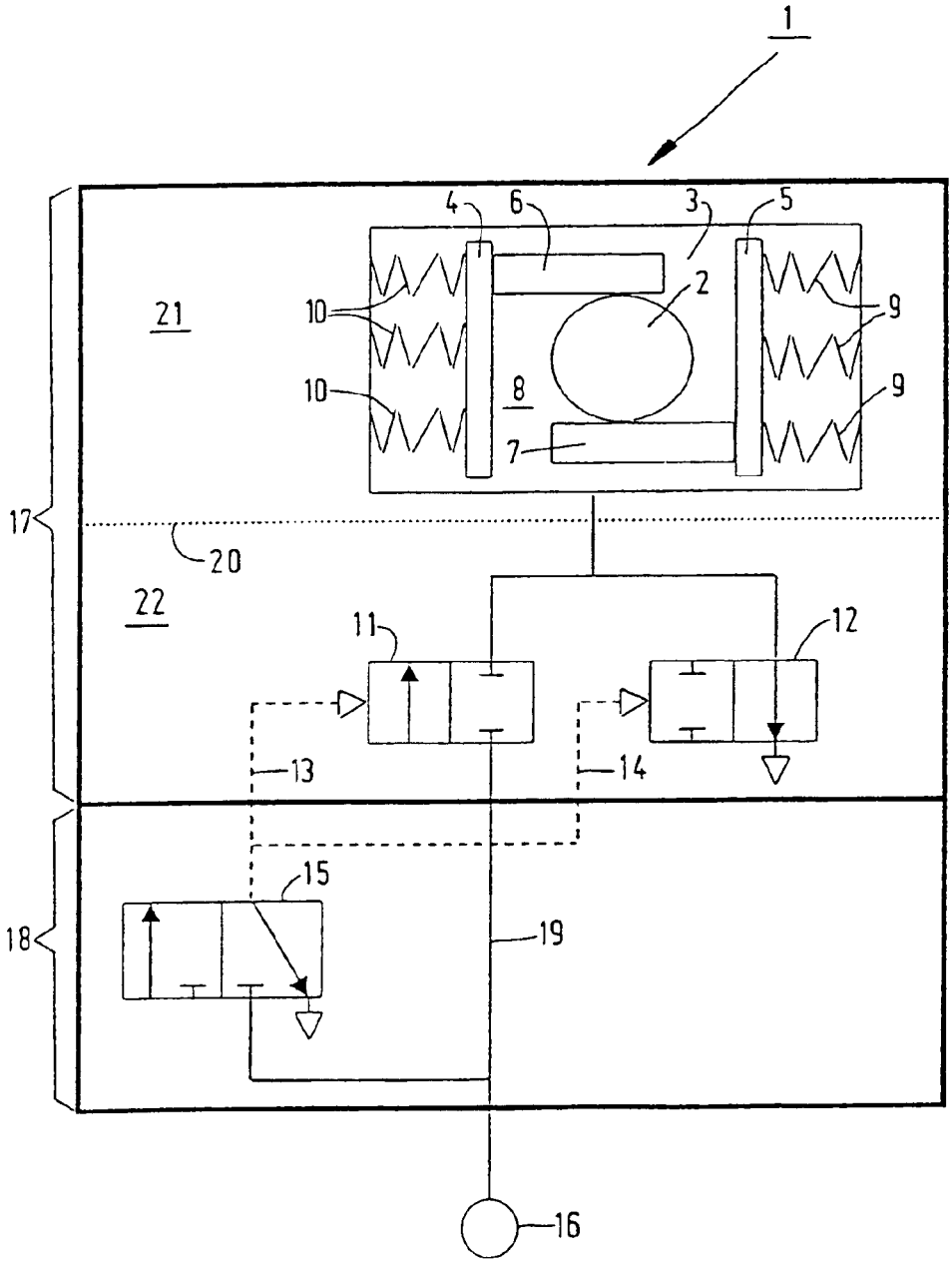
FIG. 1 shows the pneumatic diagram for a single-acting driving mechanism which is suitable for setting only two positions of the drive shaft.

FIG. 1 schematically shows a pneumatic driving mechanism 1, including the pneumatic components. Driving mechanism 1 comprises an outgoing drive shaft 2, which is rotatably journalled in a cylindrical space 3. Space 3 furthermore accommodates pistons 4 and 5, which are capable of movement towards each other and away from each other, which pistons are provided with projecting racks 6 and 7, respectively, on their sides facing towards each other. Disposed between said racks is the outgoing shaft 2, which is circumferentially provided with teeth, so that movement of pistons 4 and 5 will result in rotation of outgoing shaft 2. Reference is made to Dutch laid-open publication NL 75 12 312 for a more detailed description of such a driving mechanism.

Figure 2:
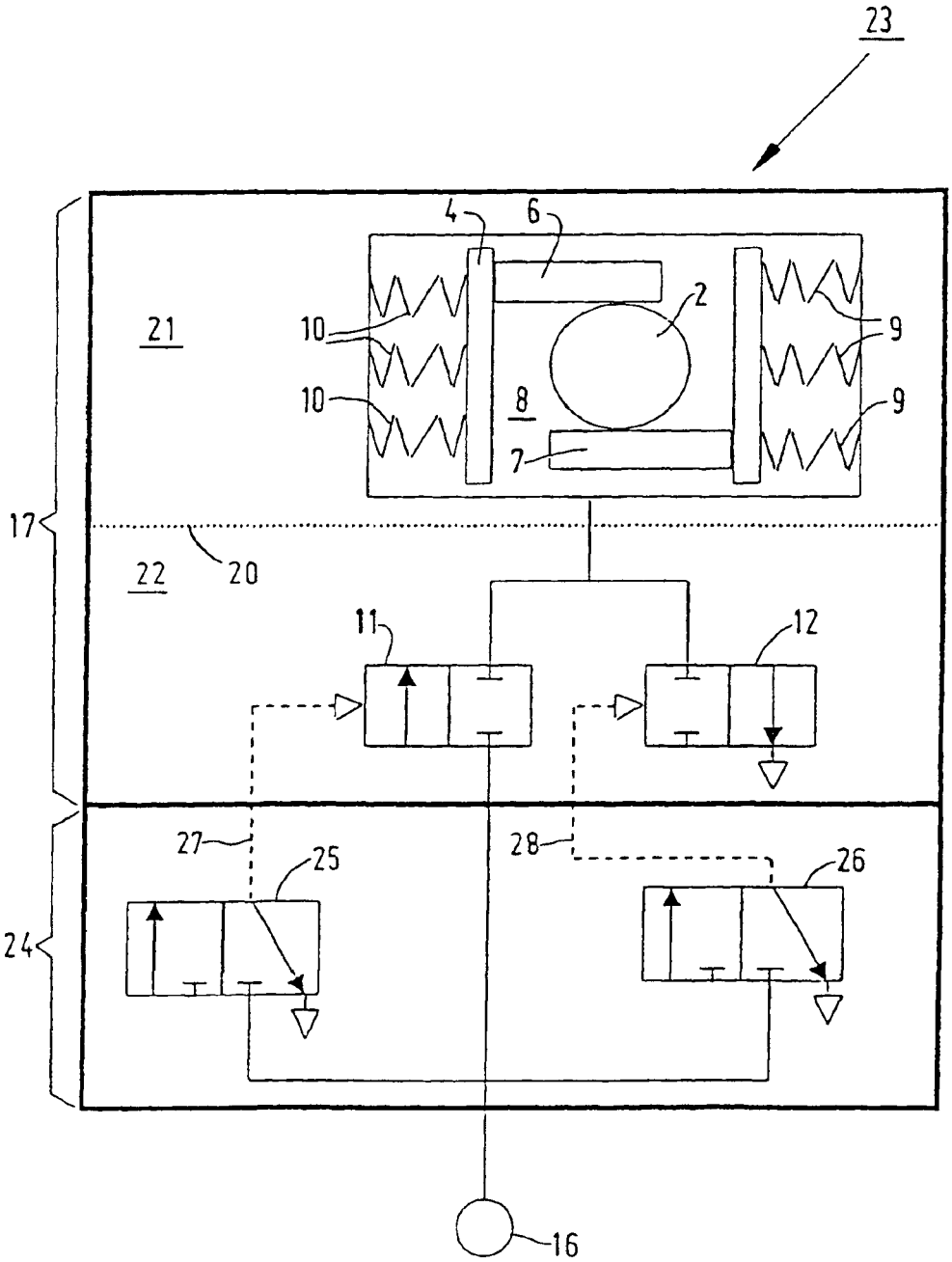
FIG. 2 shows the pneumatic diagram of a single-acting driving mechanism which is suitable for continuously variable adjustment of the drive shaft.
Figure 3:
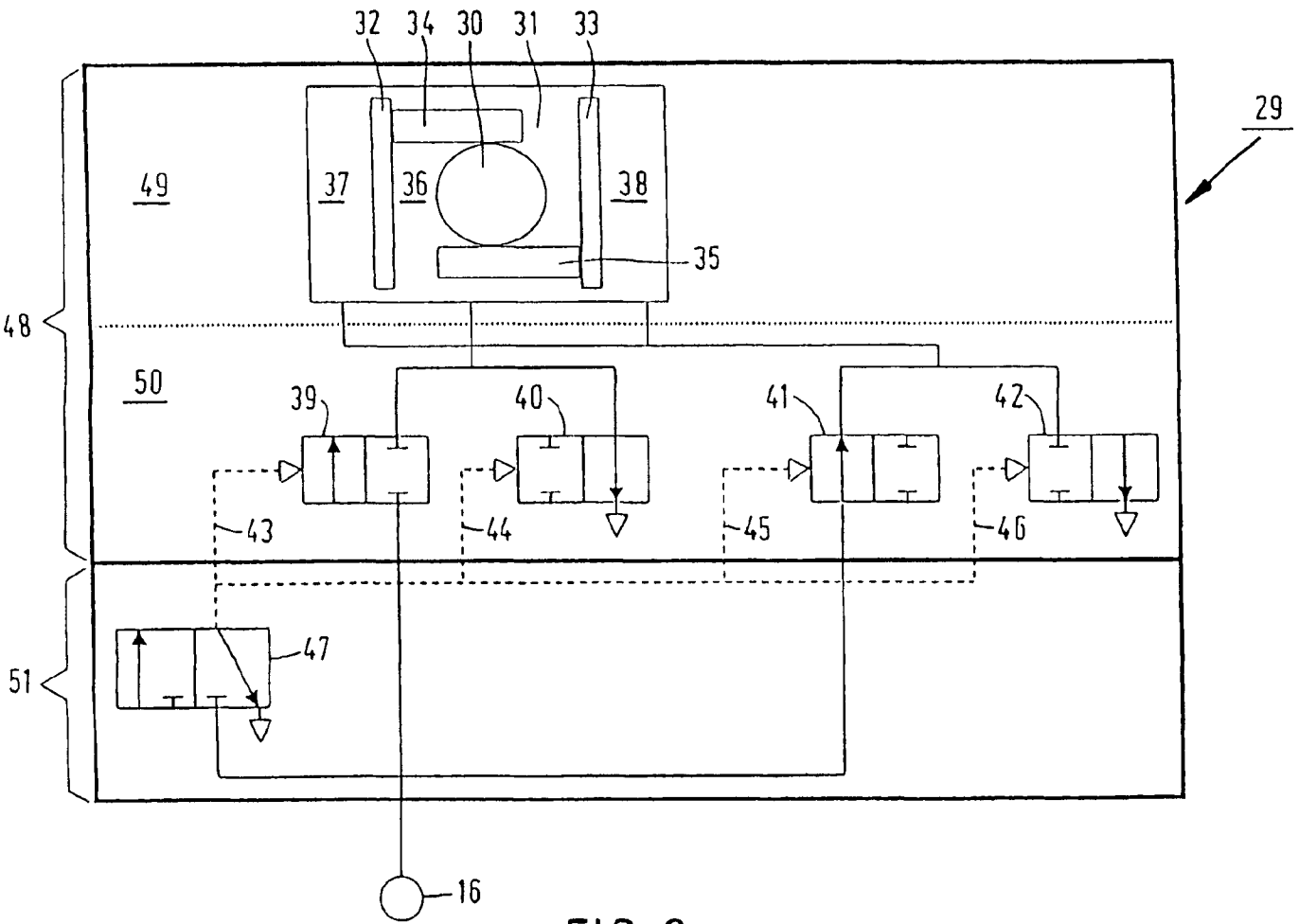
FIG. 3 shows the pneumatic diagram of a double-acting driving mechanism which is suitable for setting only two positions.
Figure 4:
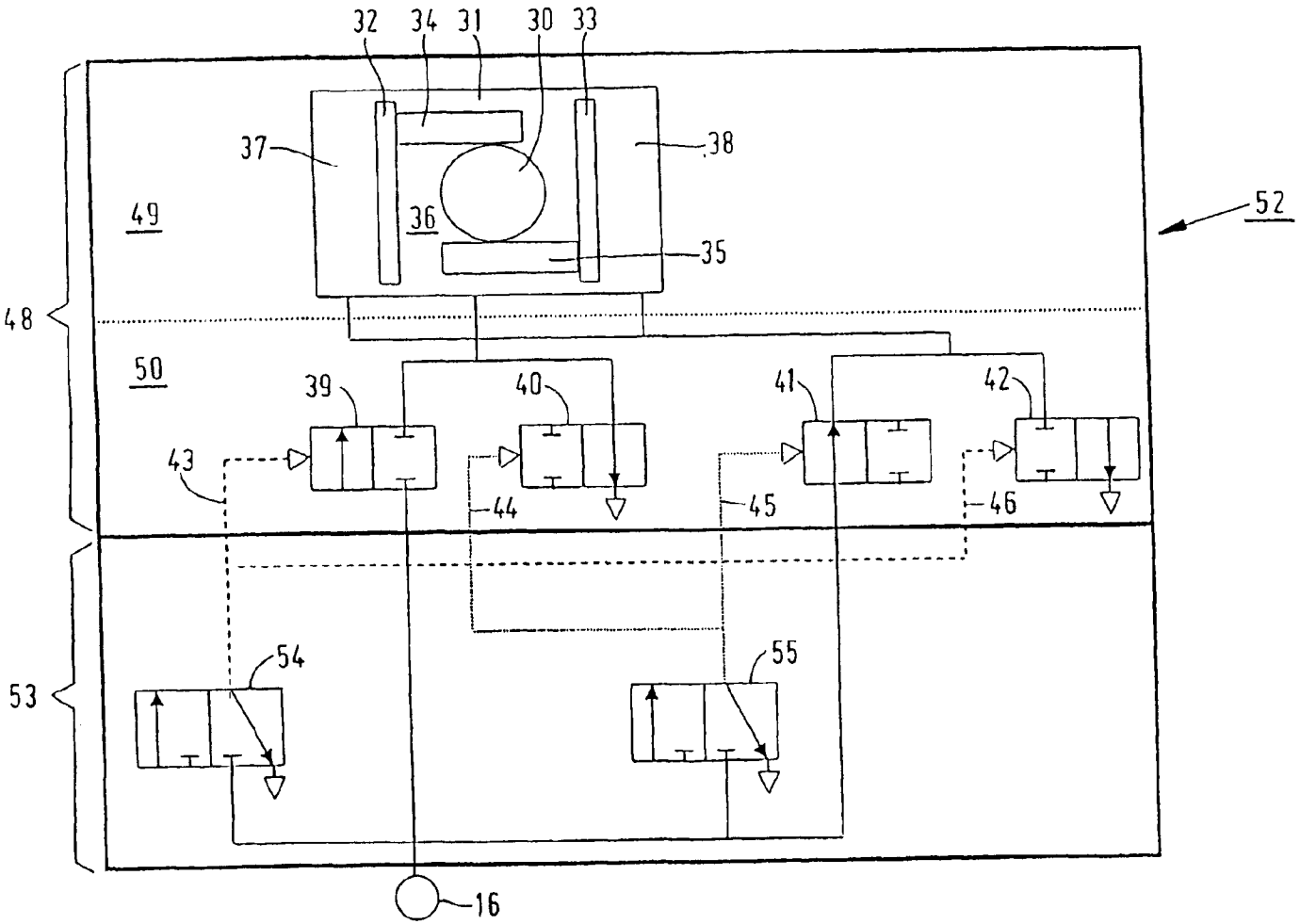
FIG. 4 shows the pneumatic diagram of a double-acting driving mechanism which is suitable for continuously variable adjustment of the drive shaft.

Roughly, such driving mechanisms can be divided into two different types: the single-acting type as shown in FIGS. 1 and 2 and the double-acting type as shown in FIGS. 3 and 4.

In the case of the single-acting type, the movement apart is obtained through pressure build-up in the space 8 between pistons 4 and 5. The movement together of pistons 4 and 5 is effected by the spring pressure of springs 9 and 10, which are positioned between the end walls of cylindrical space 3 and pistons 4 and 5, respectively. The movement together of the pistons takes place upon release of the pressure in space 8. Air valve 11 and vent valve 12 are provided for the purpose of building-up and releasing the pressure in space 8. The two valves 11 and 12 are controlled by means of a common pneumatic components control signal 13, 14 from signal transmitting valve 15. Signal transmitting valve 15 is in turn controlled by means of an electric signal (not shown) from an electronic control system. Valves 11 and 15 are fed by an external compressor 16. In the illustrated situation, signal transmitting valve 15 has not been excited, as a result of which air valve 11 and vent valve 12 are in their inoperative position. There will be no overpressure in space 8. Excitation of signal transmitting valve 15 will cause air valve 11 to open, whilst vent valve 12 will close. A pressure build-up will take place in space 8, as a result of which cylinders 4 and 5 will move apart, thus rotating drive shaft 2.

The driving mechanism as described so far does not differ from the prior art. The invention concerns the manner in which the various components of the driving mechanism are arranged. To this end a distinction is made between a base part 17 and a function part 18. Base part 17 comprises the space 3 and all the components present therein, as well as air valve 11 and vent valve 12. Function part 18 comprises a signal transmitting valve 15. The lines for pneumatic signals 13 and 14 and the pressure line 19 between compressor 16 and air valve 11 connect to each other at the boundary surface between base part 17 and function part 18. Base part 17 is subdivided into a first base part 21 and a second base part 22, as indicated by means of dotted line 20. The two base parts 21 and 22 are detachably interconnected, which makes for easy maintenance and manufacture of base part 17. The two base parts 21 and 22 form one unit, just like base part 17 and function part 18 form one unit. Also base part 17 and function part 18 are detachably interconnected, like first base part 21 and base part 22. This makes it possible to exchange function part 18 for another function part.

As already described above, outgoing shaft 2 can take up two positions when the driving mechanism as shown in FIG. 1 is used, resulting in an open position and a closed position of a shut-off valve. When the user of driving mechanism 1 wishes to upgrade the driving mechanism to obtain a continuously variable driving mechanism, he can do so by exchanging function part 18 for a function part of a type which is suitable for that purpose. Such a situation is shown in FIG. 2. Said figure shows a driving mechanism 23 comprising a base part 17 which is completely identical to the base part 17 as described with reference to FIG. 1. In this case, however, a function part 24 is connected to base part 17 instead of function part 18. Function part 24 comprises two signal transmitting valves 25, 26, which are capable of delivering signals 27 and 28, respectively, to air valve 11 and vent valve 12, respectively, independently of each other. The use of valves 25 and 26 thus enables a continuously variable operation of the single-acting driving mechanism 23, in a manner which is known per se and which will not be explained in more detail herein. A simple exchange of the function part thus suffices to change the functionality of a driving mechanism.

A comparable situation exists for double-acting driving mechanisms as shown in FIGS. 3 and 4. Double-acting driving mechanism 29 comprises an outgoing drive shaft 30, which is rotatably journalled in a cylindrical space 31. Furthermore present in space 31 are pistons 32 and 33, which are provided with racks 34 and 35, respectively. When the double-acting principle is used, pressure build-up can take place not only in the space 36 between said pistons, but also in the spaces 37, 38 between the end walls of cylindrical space 31 and pistons 32 and 33, respectively. As is the case with the single-acting principle, the movement apart of pistons 32 and 33 is obtained as a result of pressure build-up in the intermediate space 36. The movement together of pistons 32 and 33, however, is in this case effected as a result of pressure being built up in spaces 37 and 38 and the simultaneous release of pressure in space 36. The build-up of pressure in space 36 is accompanied by the release of pressure in spaces 37 and 38. The build-up and release of pressure in spaces 36, 37 and 38 takes place by means of air valve 39 and vent valve 40 for space 36 and by means of air valve 41 and vent valve 42 for spaces 37 and 38. The operation of valves 39 and 40 is similar to that of valves 11 and 12 in FIGS. 1 and 2. The same holds for valves 41 and 42, with this understanding that the latter valves are in communication with end spaces 37 and 38 instead of with central space 36. All four valves 39, 40, 41 and 42 are controlled by a common pneumatic control signal 43, 44, 45 and 46 from signal transmitting valve 47. Signal transmitting valve 47 is in turn controlled by an electrical signal (not shown) from an electronic control system. Since signal transmitting valve 47 is only capable of joint excitation of valves 39, 40, 41 and 42, drive shaft 30 can only take up two positions.

As is the case with the single-acting driving mechanisms 1 and 23 that are shown in FIGS. 1 and 2, a distinction can be made as regards the housing of the driving mechanism between a base part 48, which is subdivided into a first base part 49 and a second base part 50, and a function part 51, which parts are all interconnected in the same way as with driving mechanisms 1 and 23. An upgrade of driving mechanism 29 to obtain a continuously variable driving mechanism can take place by exchanging function part 51 for another type of function part, which is shown in FIG. 4. Function part 53 forms the only difference between driving mechanism 52 and driving mechanism 29. Function part 53 includes two signal transmitting valves 54, 55. Valve 54 delivers a common signal 43, 46 to air valve 39 and vent valve 42, respectively. Valve 55 delivers a common signal 44, 45 to vent valve 40 and air valve 41, respectively. Valves 54 and 55 are controlled independently of each other by a control system (not shown). The use of valves 54 and 55 makes it possible to set the pressures in space 36 on the one hand and spaces 37 and 38 on the other hand independently of each other, thus enabling a continuously variable setting of drive shaft 30. Exchanging function part 51 in FIG. 3 for function part 53 as shown in FIG. 4 makes it possible in a simple manner to convert the driving mechanism 29, by means of which only two positions of the drive shaft 30 can be realised, into a continuously variable driving mechanism 52.

In FIGS. 1–4, connection of the driving mechanism in question to the compressor 16 takes place via the function part. It is also possible to realise the connection via the base part, preferably via the second base part.

Figure 5:
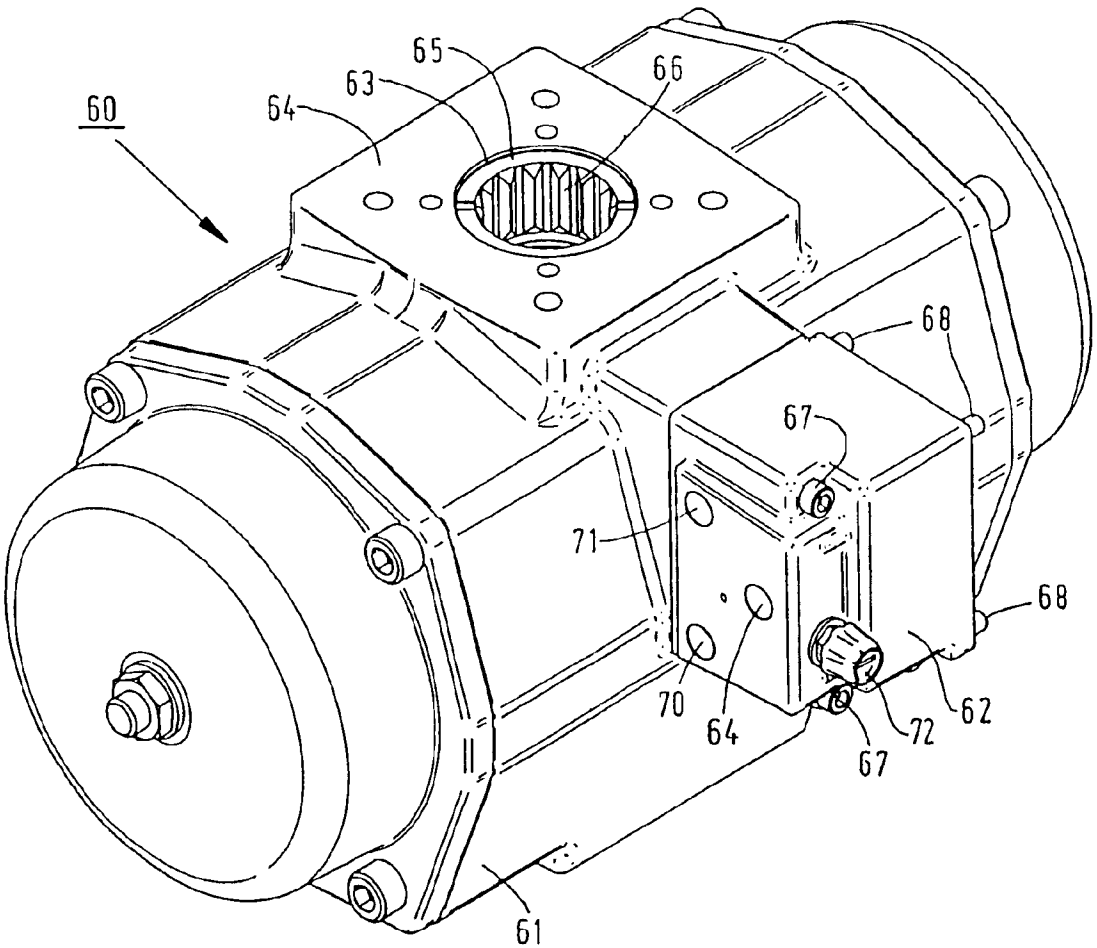
FIG. 5 is a perspective view of a base part.
Figure 7:
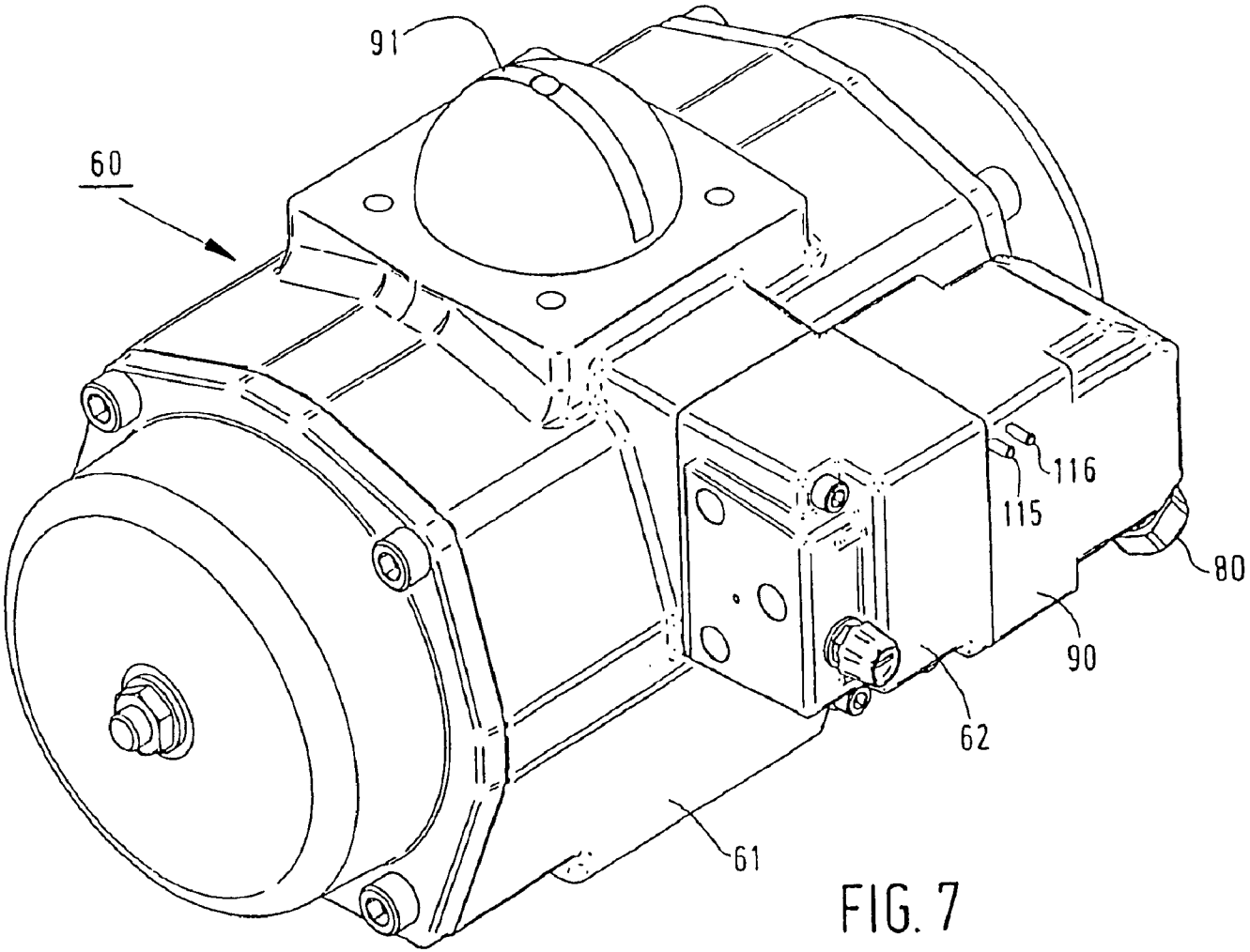
FIG. 7 shows a driving mechanism comprising the base part according to FIG. 5 as well as a function part.

FIG. 5 is a perspective view of a base part 60 comprising a first base part 61 and a second base part 62. First base part 61 is substantially cylindrical in shape. An opening 63 is formed in the upper side of base part 61, in contact surface 64 thereof, through which opening the hollow end 65 of the drive shaft is visible. The bottom side of the base part is identical in shape. Said hollow end is internally provided with teeth 66, via which a force can be transmitted to a shut-off member of a shut-off valve, or to which a position indicator can be operatively connected, as is shown in FIG. 7. Second base part 62 is substantially block-shaped and is integral with first base part 61 as regards its shape. Second base part 62 is fixed to first base part 61 by means of Allen screws. Internally threaded hollow pins 68 are provided for fixing a function part to second base part 62. Second base part 50, and with it the driving mechanism in question, can be connected to a compressor via connection 69. Connections 70 and 71 function to vent spaces such as spaces 36, 37 and 38 in FIG. 3. Behind screw cap 72 there is finally located a space in which a speed control valve (not shown) for controlling the speed at which the driving mechanism operates may be present.

Figure 6C:
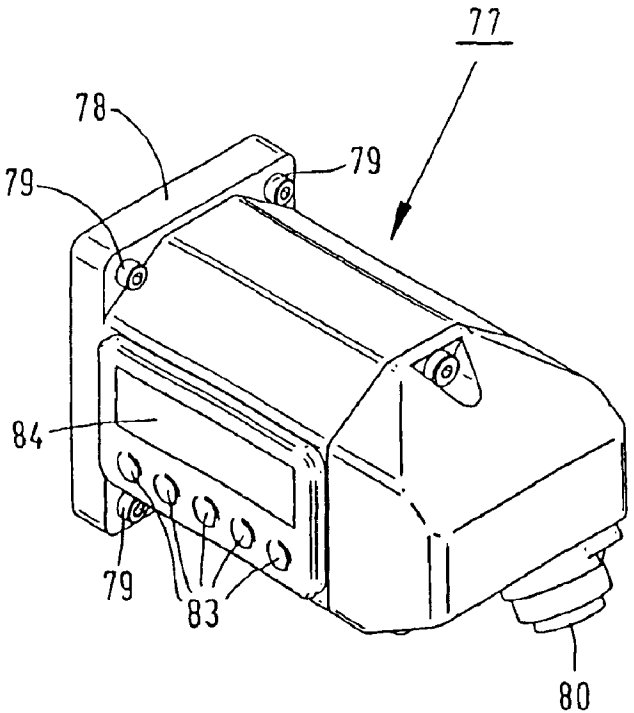
FIGS. 6A, 6B, 6C are perspective views of three different types of function parts.
Figure 6B:
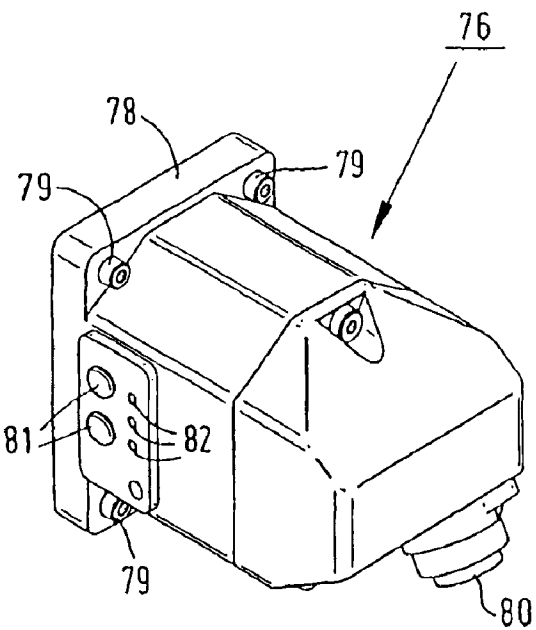
Figure 6A:
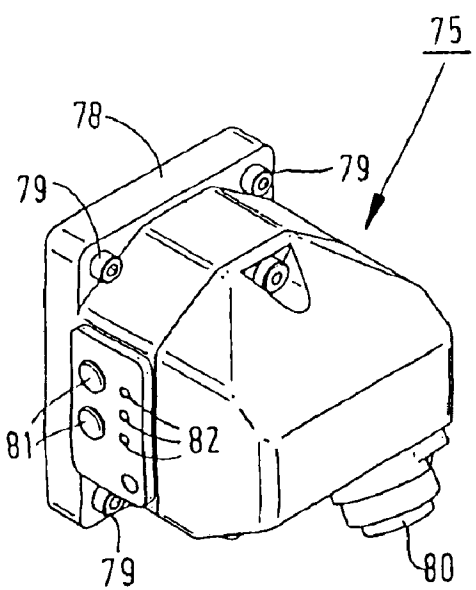

FIGS. 6A–6C show three different types of function parts 75, 76 and 77. Function parts 75, 76 and 77 are provided with flanges 79 on their connecting side, via which flanges the function parts can be connected to a second base part. Allen screws 79 are provided for that purpose. Connections 80 are used for the electronic transfer of information between a control system and the function part. Function parts 75, 76 and 77 are identical as regards their shape, with this exception that they are different in length. Function part 75 is only adapted for opening and closing a shut-off member. Function part 76 is likewise adapted for opening and closing the shut-off member, but said function part is suitable for digital communication with a control system via a digital bus. Function parts 75 and 76 each comprise two control buttons 81 and three LED indicators 82. Function part 77 is finally adapted for continuously variable adjustment of a shut-off member, wherein digital transfer information likewise takes place via a bus. Furthermore, a more extensive control panel comprising five control buttons 83 and an LCD display 84 is present, by means of which a menu-driven control is realised. The function parts and their functions as shown in FIGS. 6A–6C only form a limited selection of the total amount of possible function parts and functions. It is the electronics that are present in the function part which ultimately determine the function and in part the appearance of the function part. Attention is furthermore drawn in this connection to the possibility of effecting a continuously variable adjustment of a shut-off member by means of an analog signal.

FIG. 7 shows the base part 60 comprising the first base part 61 and the second base part 62 that is shown in FIG. 5. Connected to second base part 62 is a function part 90 similar to the function parts that are shown in FIGS. 6A–6C. The shapes of the two parts at the joining surfaces between the second base part 62 and function part 90 are complementary to each other, as a result of which the two parts form one unit. A gasket (not shown) is provided so as to realise a sealed connection between second base part 62 and function part 90. All the required electrical or pneumatic connections between second base part 62 and function part 90 take place via the boundary surface between said parts. Mounted on the upper side is a position indicator 91, from which the angular position of the drive shaft can be read directly.

Figure 8:
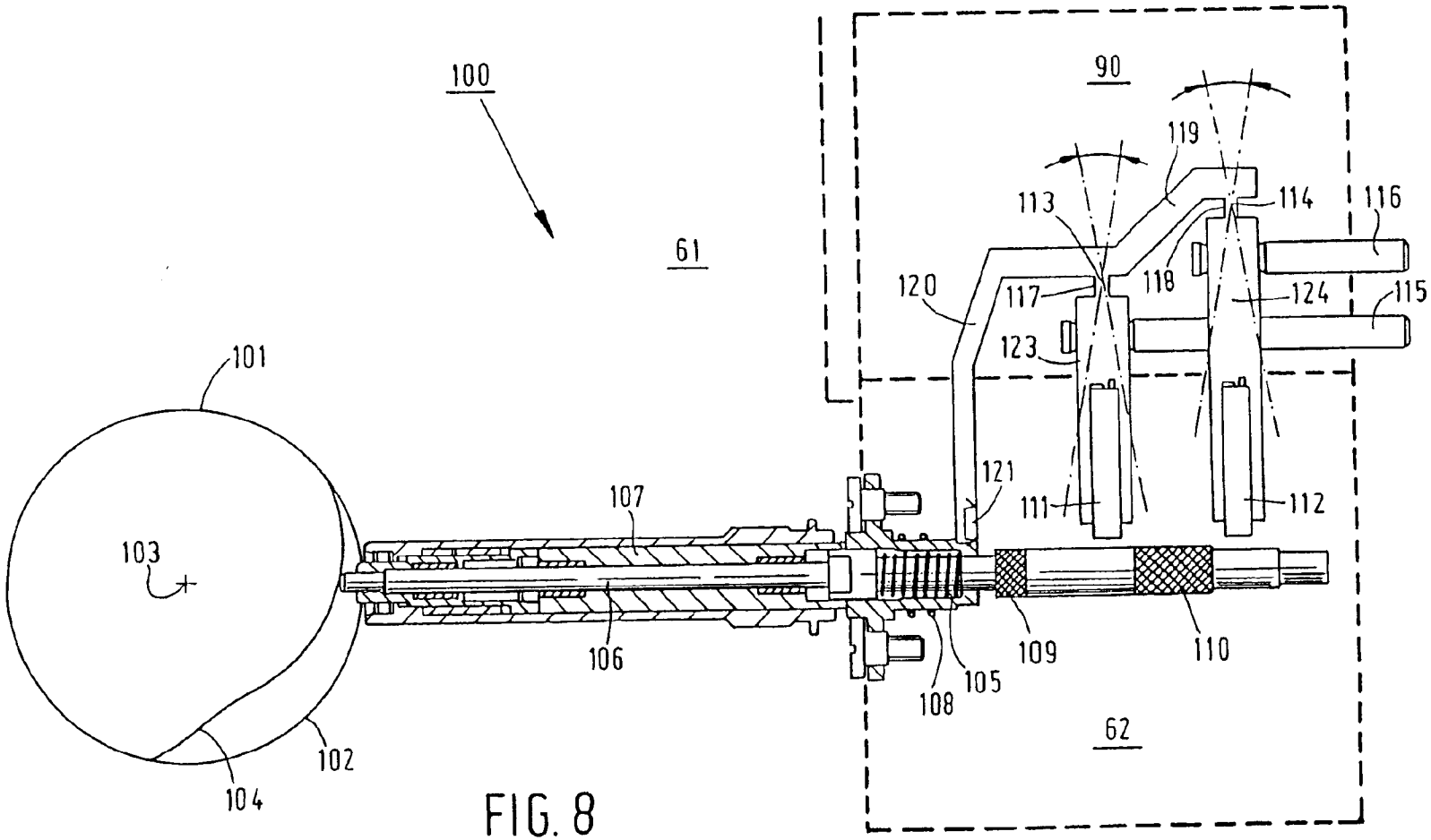
FIG. 8 is a partially sectional top plan view of a position indicator that is incorporated in a driving mechanism according to FIG. 7.

FIG. 8 is a partially sectional view of a position indicator 100 for indicating the angular position of drive shaft 101, a free end 65 of which is shown in FIG. 5. Said drive shaft is built up of a cylindrical portion 102, which is concentric with central axis 103, and a cam portion 104. A feeler pin 106 abuts against the surface of cam portion 104 under the influence of the spring pressure of spring 105, which is supported on an inward shoulder 122 of guide bush 107. Feeler pin 106 is disposed in the interior of guide bush 107, which abuts against the cylindrical portion 102 under the influence of the spring pressure of spring 105, which is supported on a fixed edge (not shown) which is present in second base part 62. Cam portion 104 is shaped in such a manner that the degree to which feeler pin 106 extends outside guide bush 107 increases along with the angular distortion of drive shaft 101 within the operating range of 90°. Two magnets 109, 110 are mounted on the end of feeler pin 106 opposite drive shaft 101. Two Reed switches 111, 112 are present opposite and on either side of magnet 110. Each Reed switch 111, 112 is capable of taking up an open position and a closed position, in dependence on the translation position of feeler pin 106 and magnet 110. One of the two positions of Reed switch 111 corresponds to an open position of a shut-off member, whilst one of the two positions of Reed switch 112 corresponds to a closed position of a shut-off member. Reed switches 111, 112 are capable of driving a solenoid (not shown) either directly or after transformation of the electrical signal from Reed switches 111, 112 by suitable electronics. The spatial orientation of Reed switches 111, 112 can be adjusted by pivoting the arms 123, 124 about pivot points 113, 114 by means of adjusting screws 115, 116. The Reed switches can thus be calibrated. Adjusting screws 115, 116 are retained in a form-locked manner in the direction of feeler pin 106 in U-shaped ends of arms 123, 124 extending perpendicularly to the plane of drawing. Reed switches 111, 112 are connected, via flexible bridges 117, 118 in which the pivot points 113, 114 are located, to a frame 119 which includes a third arm 120 extending perpendicularly to said feeler pin. A magneto-resistive sensor 121, which is known per se, is present on the lower end of said arm, which sensor is capable of delivering signals in dependence on the translation position of feeler pin 106 on account of the shifting of the lines of flux and the simultaneous changing of the orientation of said lines of flux from magnet 109 through sensor 121. In this way it is possible to derive the angular position between the open position and the closed position of the shut-off member from the translation position of feeler pin 106.

The distribution of the various parts of the position indicator over first base part 61, second base part 62 and function part 90 is schematically illustrated in dotted lines. It is noted that Reed switches 111, 113 extend partially into second base part 61 with their arms 123, 124 indeed, as does third arm 120 carrying the magneto-resistive sensor 121, but that they are fixedly connected to function part 90. The transfer of information between second base part 61 and function part 90 takes place entirely without any physical contact.

Figure 9A:
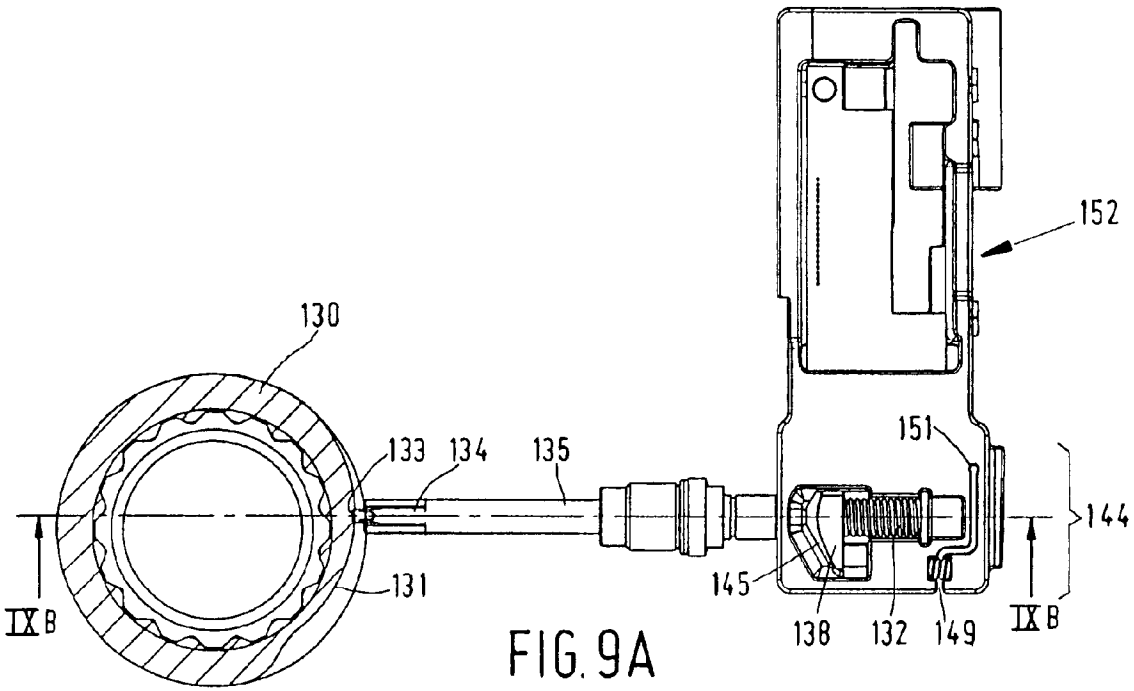
FIGS. 9A, 9B and 9C are a side view, a top plan view and a perspective view, respectively, of a second position indicator, with FIGS. 9A and 9B showing said position indicator at least partially in cross-sectional view.
Figure 9B:
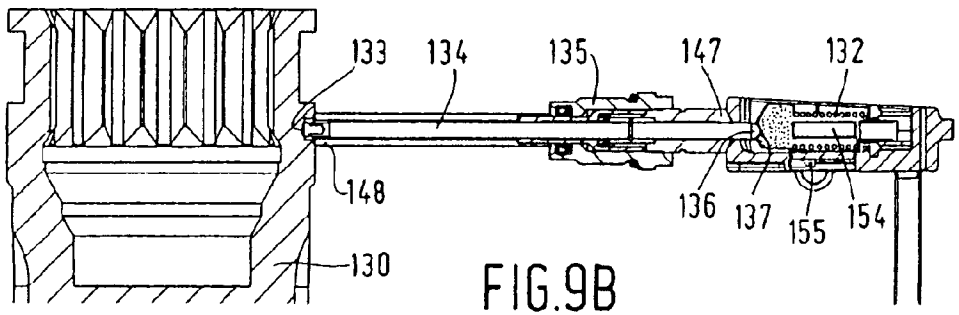
Figure 9C:
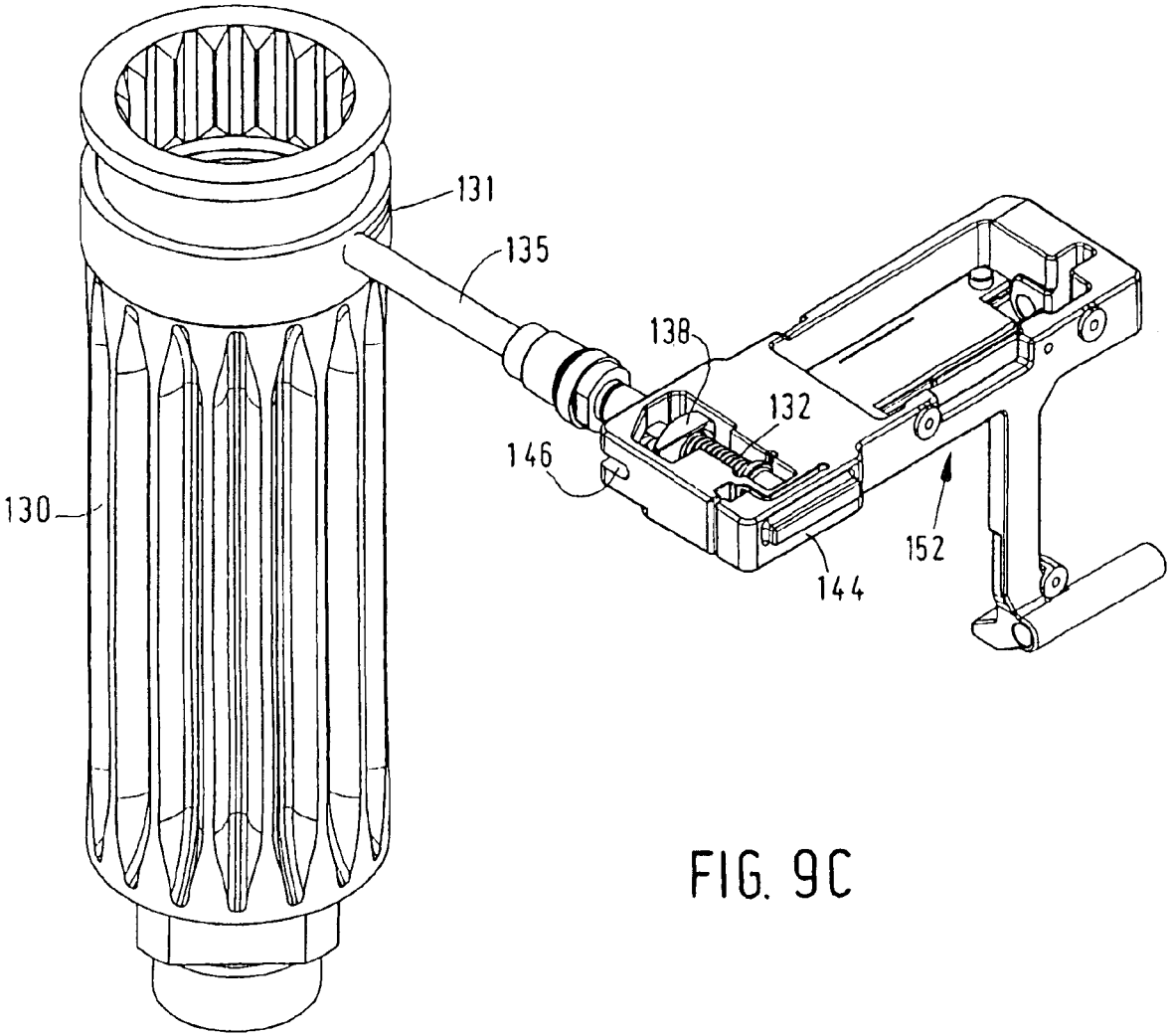

FIGS. 9A, 9B and 9C show a second embodiment of a position indicator. As is the case in the situation according to FIG. 8, a drive shaft 130 is provided, which comprises a curved cam portion 131 on part of its circumference. The end 133 of feeler pin 134 is pushed against cam portion 131 under the influence of the action of compression spring 132, as a result of which the longitudinal position of feeler pin 134 is indicative of the rotational position of drive shaft 130. Feeler pin 134 is surrounded by a guide bush 107, whose function is similar to that of guide bush 107 of FIG. 8. The end 136 of feeler pin 134 opposite end 133 is positioned in a recess 137, which is present in the upper side of a run-on shoe 138. Feeler pin 134 extends from cam portion 131, via passage 139 (see FIG. 10), into a recessed space 140 of a second base part 141 similar to base part 62 of FIG. 7, which can be connected, via joining surface 142, to a first base part (not shown) similar to first base part 61 of FIG. 7. Function part 143 is provided with a projecting housing part 144, which accommodates run-on shoe 138 and compression spring 132, amongst other parts. In the situation wherein second base part 141 and function part 143 are interconnected, projecting housing part 143 extends within the recessed space 140. When said connection is being made, the end 136 of feeler pin 134 slides over the sloping surface 145 of run-on shoe 138 until the end 136 slips into recess 137, in which situation compression spring 132 ensures that there is contact between run-on shoe 138 and the end 136 of feeler pin 134. In this connection it is important to note that while the connection between function part 143 and second base part 141 is being made, the longitudinal position of feeler pin 134 is undefined. In order to be able to make the above-described connection in a sliding manner, a gap 146 is formed in projecting housing part 144, thus enabling relative movement of said end 136 while the connection is being made. A first end 147 of guide bush 135 which, incidentally, has a compound structure, butts against the edges of said gap 146. The second end 148 of guide bush 135 positioned opposite said first end 147 butts against the outer circumference of drive shaft 130 outside cam portion 131. This provides compensation for radial movement of the drive shaft 130 that may occur, for example as a result of play in the bearings in question. A compression spring 149 is provided for the purpose of effecting a proper contact between guide bush 135 on the one hand and drive shaft 130 and the edges of gap 146 on the other hand, which compression spring is operative between two parts of the projecting part 143 on either side of a gap 150, whose end 151 functions as a virtual pivot point between the two parts. The projecting part 144 forms part of a frame 152, which is largely positioned within the housing of function part 143. All kinds of electronic devices (not shown) required for the proper functioning of the driving mechanism as a whole are mounted on said frame 152. Second base part 141 does not comprise any electronics at all. Present within compression spring 132 is a pin, which extends from the bottom side of run-on shoe 138 in line with feeler pin 134. A magnet 154 similar to magnet 109 is attached to said pin within compression spring 132, whilst a magneto-resistive sensor 155 similar to sensor 121 in FIG. 8, is present within projecting portion 144 in the immediate vicinity of the path along which said magnet 154 can move under the influence of rotation of shaft 130. Said magneto-resistive sensor 155 makes it possible to convert translating movements of magnet 154 caused by rotation of drive shaft 130 into electronic signals which can be utilized by the control system of the driving mechanism in question.

Figure 10:
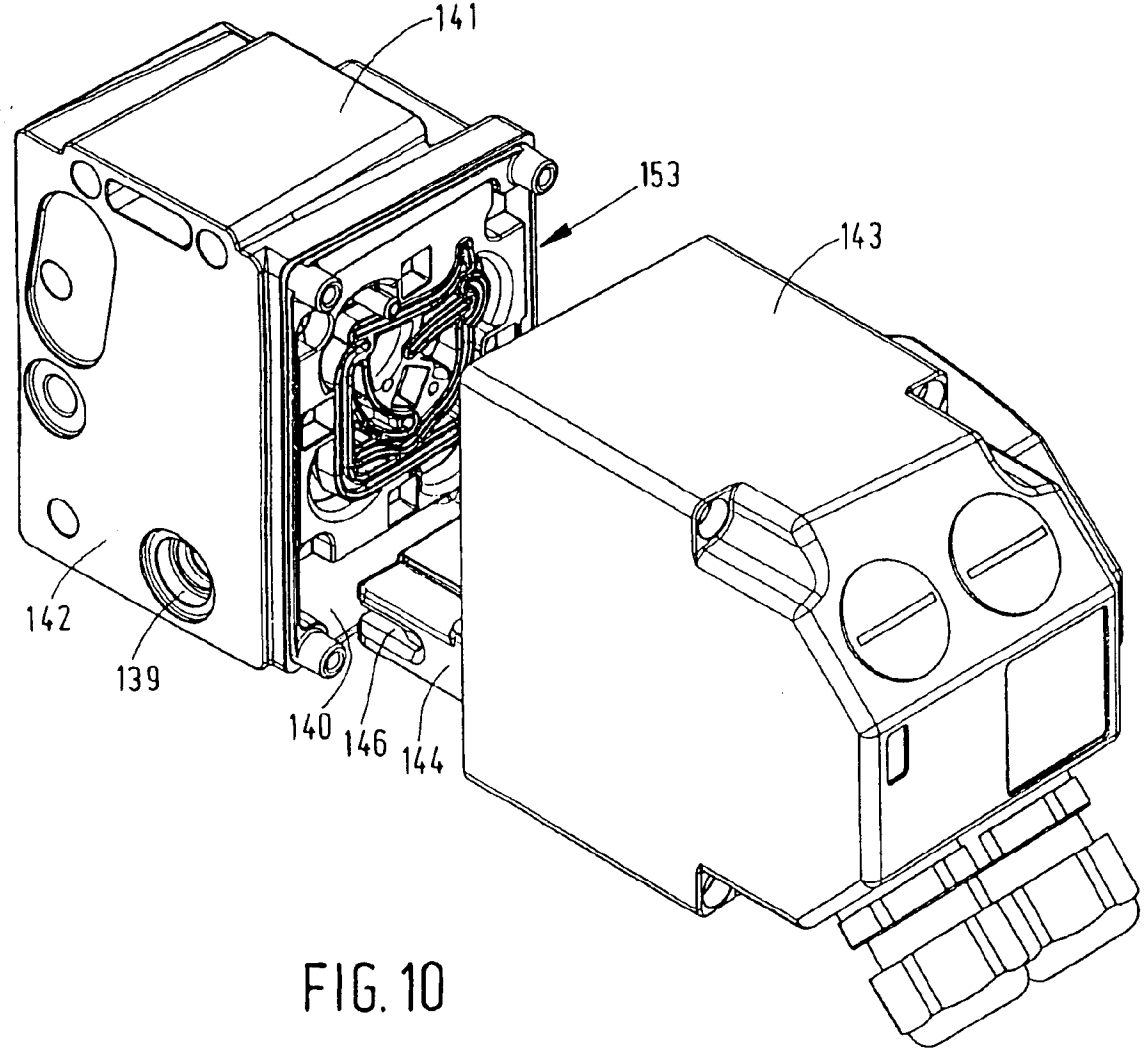
FIG. 10 is a perspective view of a second housing part of a base part and a function part suitable for use in combination with a position indicator according to FIGS. 9A, 9B and 9C.

As is shown in FIG. 10, the second base part 141 is provided with a relief pattern 153 on its side facing towards function part 143. The side of the function part 143 that faces towards second base part 141 (which is not shown) is substantially flat, as a result of which a pattern of channels is formed between the two facing sides in the situation wherein function part 143 is connected to second base part 141, via which pneumatic control signals from two signal transmitting valves, such as valves 54 and 55 in FIG. 4, which are present in function part 143 can be passed on to a number of air valves, such as valves 39, 40, 41 and 42 in FIG. 4, within second base part 141 for a correct control of the driving mechanism.

What is claimed is:

1. A pneumatic, reciprocating rotary driving mechanism unit for operating a shut-off member in a shut-off valve, comprising a substantially closed housing, in which a drive shaft is journalled which can be connected to said shut-off member, a pneumatic control valve for controlling said drive shaft and first signal transmitting means for delivering control signals to said pneumatic control valve, characterized in that the housing includes a base part, in which the drive shaft and the pneumatic control valve are present, and a first function part, in which the first signal transmitting means are present, which first function part is detachably and exchangeably connected to said base part so as to make it possible to exchange said first function part for a second function part containing second signal transmitting means of a type different from the first signal transmitting means, which first function part is exchanged for the second function part for the purpose of changing the manner in which the drive shaft can be controlled.

2. A driving mechanism according to claim 1, characterized in that at least one mechanical portion of a position indicator, which is movable in dependence on the rotation of the drive shaft, is housed in the base part for the purpose of showing and/or transmitting information about the rotational position of the drive shaft.

3. A driving mechanism according to claim 1, characterized in that the base part comprises two interconnected housing parts, wherein the drive shaft is present in the first housing part and the second housing part accommodates the control valve.

4. A driving mechanism according to claim 3, characterized in that the mechanical portion of the position indicator is at least partially housed within the second housing part.

5. A driving mechanism according to claim 4, characterized in that first function part is detachably connected to the second housing part.

6. A driving mechanism according to claim 5, characterized in that the second housing part is disposed outside the central axis of the drive shaft.

7. A driving mechanism according to claim 1, characterized in that the shapes of the base part on the one hand and the first function part and the second function part on the other hand are complementary to each other.

8. A driving mechanism according to claim 1, characterized in that each function part comprises all function-specific electronics associated with the function of the function part in question.

9. A driving mechanism according to claim 8, characterized in that said electronics are embedded.

10. A driving mechanism according to claim 1, characterized in that one of said first function part and said second function part is suitable for positioning the drive shaft in two positions only and the other one of said first function part and said second function part is suitable for positioning the drive shaft in an intermediate position between said two positions.

11. A driving mechanism according to clam 10, characterized in that the other one of said first function part and said second function part is suitable for placing the drive shaft in any desired position between the aforesaid two positions.

12. A driving mechanism according to claim 1, characterized in that the control signals from the first signal transmitting means and from the second signal transmitting means are pneumatic signals.

13. A driving mechanism according to claim 12, characterized in that at least one of the facing sides of said function part and said base part, is provided with a pattern, as a result of which at least part of the pneumatic circuit for the pneumatic control signals is formed between the function part and the base part in the situation wherein the function part is connected to the base part.

14. A driving mechanism according to claim 1, characterized in that the first signal transmitting means and the second signal transmitting means each comprises a pneumatic valve for delivering pneumatic control signals to the pneumatic control valve.

15. A driving mechanism according to claim 2, characterized in that the function part also comprises a mechanical portion of the position indicator, which can be connected to the mechanical part of the position indicator that is housed in the base part.

16. A driving mechanism according to claim 15, characterized in that the base part is preferably provided with a recess for accommodating the mechanical portion of the position indicator that is housed in the function part.

17. A function part for use with a driving mechanism having a substantially closed housing, in which a drive shaft is journalled which can be connected to said shut-off member, a pneumatic control valve for controlling said drive shaft and first signal transmitting means for delivering control signals to said pneumatic control valve, wherein the housing includes a base part, in which the drive shaft and the pneumatic control valve are present, and a first function part, in which the first signal transmitting means are present, which first function part is detachably and exchangeably connected to said base part so as to make it possible to exchange said first function part for a second function part containing second signal transmitting means of a type different from the first signal transmitting means, which first function part is exchanged for the second function part for the purpose of changing the manner in which the drive shaft can be controlled, comprising a signal transmitter for converting an electrical control signal into a pneumatic control signal for a pneumatic control valve which is present in the base part of the driving mechanism.

18. A shut-off valve comprising a shut-off member, which is provided with a driving mechanism for operating said shut-off member, said driving mechanism including a substantially closed housing, in which a drive shaft is journalled which can be connected to said shut-off member, a pneumatic control valve for controlling said drive shaft and first signal transmitting means for delivering control signals to said pneumatic control valve, wherein the housing includes a base part, in which the drive shaft and the pneumatic control valve are present, and a first function part, in which the first signal transmitting means are present, which first function part is detachably and exchangeably connected to said base part so as to make it possible to exchange said first function part for a second function part containing second signal transmitting means of a type different from the first signal transmitting means, which first function part is exchanged for the second function part for the purpose of changing the manner in which the drive shaft can be controlled.

* * * * *

UNITED STATES PATENT AND TRADEMARK OFFICE

CERTIFICATE OF CORRECTION

PATENT NO. : 6,871,663 B2
DATED : March 29, 2005
INVENTOR(S) : Floris Johannes Groeneveld It is certified that error appears in the above-identified patent and that said Letters Patent is hereby corrected as shown below:

Column 11,
Line 14, please insert -- the -- immediately before "function".

Signed and Sealed this

Thirteenth Day of December, 2005

JON W. DUDAS
*Director of the United States Patent and Trademark Office*